US006161968A

United States Patent [19]

Earle et al.

[11] Patent Number: 6,161,968

[45] Date of Patent: Dec. 19, 2000

[54] PROCESSING PHOTOGRAPHIC MATERIAL

[75] Inventors: Anthony Earle; Jeffrey K. Green, both of Middlesex; Zoë Orr, Hertfordshire; Leslie R. Wells, Middlesex, all of United Kingdom

[73] Assignee: Eastman Kodak Company, Rochester, N.Y.

[21] Appl. No.: 09/167,256

[22] Filed: Oct. 6, 1998

[30] Foreign Application Priority Data

Oct. 9, 1997 [GB] United Kingdom ..... 9721457

[51] Int. Cl.[7] ..... G03D 5/06

[52] U.S. Cl. ..... 396/606; 396/612

[58] Field of Search ..... 396/612, 626, 396/630, 636, 604, 606

[56] References Cited

U.S. PATENT DOCUMENTS

| | | | |
|---|---|---|---|
| 3,299,791 | 1/1967 | Fukuda | 396/606 |
| 3,330,197 | 7/1967 | Boeger et al. | 396/606 |
| 3,599,554 | 8/1971 | Aelterman et al. | 396/604 |
| 5,752,121 | 5/1998 | Earle et al. | 396/606 |
| 5,758,223 | 5/1998 | Kobayashi et al. | 396/604 |
| 6,045,273 | 4/2000 | Hagiwara et al. | 396/606 |

FOREIGN PATENT DOCUMENTS

| | | |
|---|---|---|
| 910 834 | 6/1946 | France . |
| 2 739 199 | 9/1996 | France . |

*Primary Examiner*—D. Rutledge
*Attorney, Agent, or Firm*—Frank Pincelli

[57] ABSTRACT

Photographic processing apparatus comprises a combination of a surface processing stage and a replenishable tank processing stage. This allows advantage to be taken of the low quantities of processing solution that are characteristic of surface processing and the total immersion that is characteristic of tank processing.

10 Claims, 1 Drawing Sheet

PROCESSING PHOTOGRAPHIC MATERIAL

FIELD OF THE INVENTION

This invention relates to the processing of photographic material, which may already be exposed, and in particular to the application of processing solution to a surface of the material.

BACKGROUND OF THE INVENTION

Photographic material as referred to herein is understood to be generally planar, may comprise film or paper, may produce a black-and-white or color image, and may be in a continuous web form or may comprise discrete sheets.

Silver halide photographic materials are well-known, and are processed to generate a silver or dye image via a development stage followed by a series of stages to stabilize and provide permanence to the image. The wash stages convert and remove unwanted materials from the coated photographic layers which would either interfere with the quality of the final image or cause degradation of the image with time. In typical color systems the development stage is followed by a bleach stage to oxidize the developed silver to a form which can be dissolved by a fixing agent in the same or a separate bath. Such silver removal stages are then followed by a washing stage using water, or other wash solution, or a stabilization stage using a stabilizer solution. Such stages remove residual chemicals and may also include conversion reactions between stabilizer solution components and materials within the coated layers. These stages are required to provide the required degree of permanence to the final image.

The various processing stages may comprise baths in which batches of the photographic material are immersed, but these can involve large quantities of solution that have to be replenished to maintain their efficacy, and the effluent subsequently has to be removed. It also known as an alternative to carry out surface processing of photographic material in which a metered amount of processing solution is deposited onto a surface of the material, resulting in only a small amount being carried over by the material from one stage to the next, thus significantly reducing the amount of effluent. GB-A-2 306 017 discloses surface processing apparatus in which solution is applied in precise quantities to the sensitized side of photographic sheet film as it is conveyed on an endless belt beneath an advantageous form of applicator arrangement that comprises three rollers. The processing solution, for example developer, is metered onto an upper roller and is then transferred to the film as it is driven under lower rollers by the belt. The film is then passed through further processing stages, with stop, fixing and wash stages being provided by V-shaped tanks containing similarly-shaped heating platens that leave narrow processing channels through which the photographic material passes.

It is desired to provide photographic processing that not only takes advantage where possible of the low quantities of solution involved in surface processing, but which also allows processing of the material in a tank where surface processing is not suitable for any reason.

SUMMARY OF THE INVENTION

In accordance with one aspect of the present invention, there is provided apparatus for processing photographic material, comprising:

a surface processing stage, in which means is arranged to transport the material from an entrance to an exit of the stage whilst the material is supported on a substantially planar surface; and in which processing solution is applied to at least one surface of the material; and a tank processing stage, in which means is arranged to guide the material down into, and subsequently up out of, a tank containing processing solution in which the material is immersed, and in which means is arranged for replenishing the processing solution in the tank.

Each of the surface processing stage and the tank processing stage may be provided by any suitable known means.

In accordance with another aspect of the present invention, there is provided a method of processing photographic material, wherein the material is processed in at least two stages, one of the stages being a surface processing stage in which the material is transported on a substantially planar surface and in which processing material is applied to one side thereof, and another of the stages being a tank processing stage in which the material is guided down into, and subsequently up out of, a tank in which the material is immersed, and wherein the processing material in the tank is replenished in order to maintain its chemical activity at a required level.

By combining a surface processing stage with a tank processing stage in which the photographic material is immersed in processing solution, the particular advantages of each process can be maximized. Thus, minimum quantities of processing solution can be utilized in the surface processing stage, with minimum effluent to be dealt with, and, whilst processing the same material, immersion in a replenishable tank can be used where surface processing is not suitable or the technology is not available. The converse may also be the case. As an example, use of an ascorbic acid based developer solution in a conventional deep tank process can cause problems due to biogrowth. Washing in a surface application unit reduces the opportunity for biogrowth because there is no large quantity of warm water to encourage such growth.

Further, such a combination of processing allows the utilization of non-typical photographic processes and allows them to be applied in a more controlled environment. For example, it may be desirable to apply the chemical components of a developer separately at timed intervals. The application of parts "A" and "B" separately in an RX (redox chemistry) process is desirable, since the two parts cannot be combined before processing. This can be done, in accordance with the present invention, in a two-stage surface process, and the rest of the processing, bleach, fix and wash, may be carried out in conventional tanks. Small quantities of solution with little effluent in the initial stages can thus advantageously be used, with larger and replenished quantities used in the later stages, especially for washing.

The surface application stage may be provided by apparatus as disclosed in our co-pending application, filed contemporaneously herewith under our reference 10724, in which the time that the photographic material is subject to the processing solution in any one stage and/or for any given material, can be varied by varying the position in the stage at which the solution is first applied to the material. The entire contents of this co-pending application is included herein by this reference.

BRIEF DESCRIPTION OF THE DRAWINGS

Apparatus for, and a method of, processing photographic material, each in accordance with the present invention, will now be described, by way of example, with reference to the accompanying drawings, in which.

DETAILED DESCRIPTION OF THE INVENTION

Figure 1:
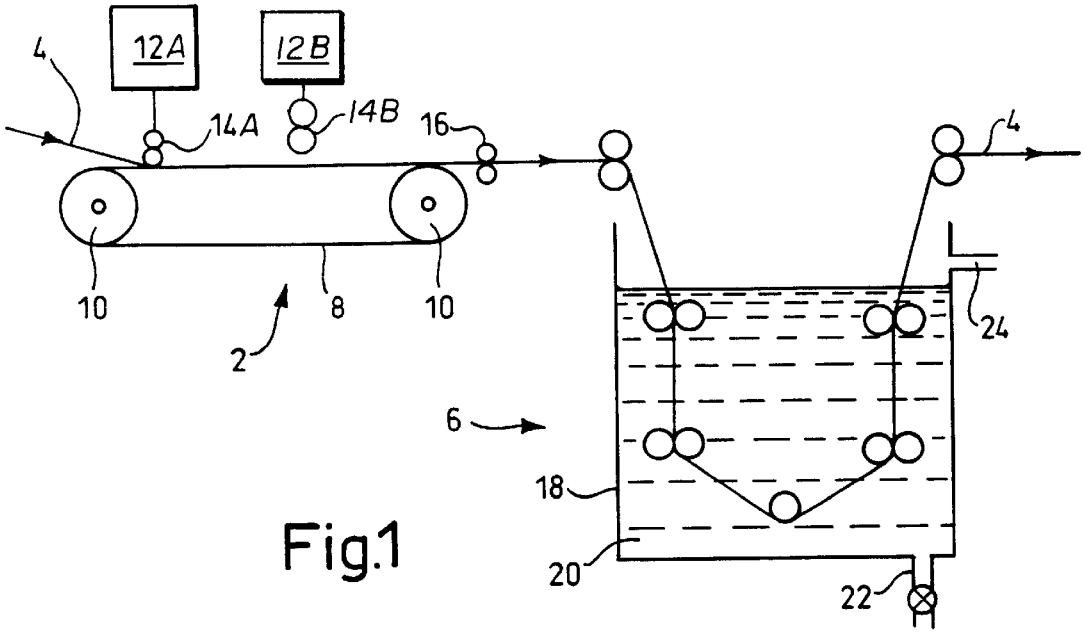
FIGS. 1 to 3 show schematic side sections of three embodiments of apparatus employing the same surface processing stage in combination with different tank processing stages.

Referring to FIG. 1, the processing apparatus has a surface processing developer stage 2 that feeds a web of film 4 into a deep tank wash stage 6, and thence to further processing stages (not shown). The film 4 is guided with its emulsion side uppermost onto an endless belt 8 that is looped around a pair of drive rollers 10 in the stage 2. At least two delivery systems 12A and 12B deliver a metered quantity of developer solution onto roller arrangements 14A and 14B. As the film 4 passes along the belt 8, it causes the rollers of the arrangements 14A and 14B to rotate and thus to transfer the developer solution onto the sensitized surface of the film 4 to effect the processing. The film 4 leaves the belt 8 at the end of its travel and passes through further rollers 16 that remove surplus developer. The film 4 is then guided by rollers down into, through and up out of, a tank 18, where it is fully immersed in a large volume of wash solution 20. The wash solution 20 is periodically drained off through an outlet 22 at the bottom of the tank 18 and is replenished with fresh solution through an upper inlet 24.

Figure 2:
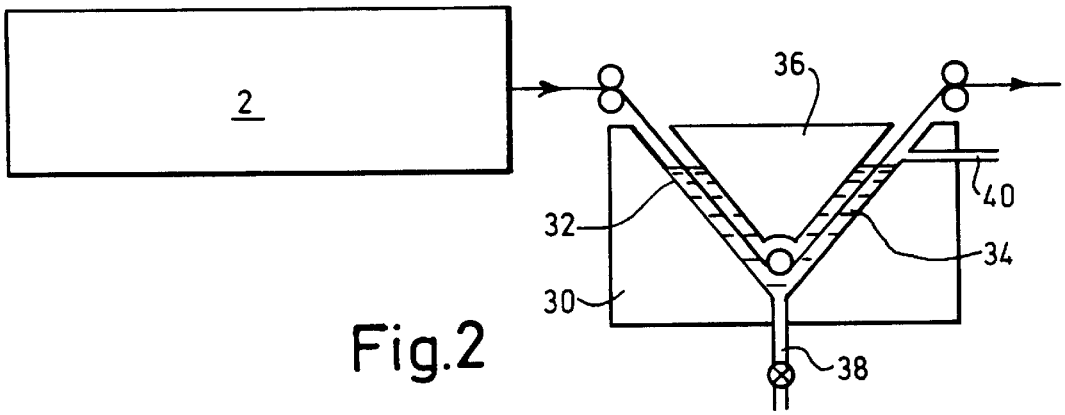

FIG. 2 shows a modified apparatus, in which after leaving the surface processing stage 2, as described above, the film 4 enters a tank 30 and is guided by rollers therethrough in a V-shaped channel 32 in which the film 4 is immersed in wash solution 34. A heated platen 36 is located in the tank 30 and assists in defining the channel 32. The temperature of the platen 36 is controlled in accordance with processing requirements. The wash solution 34 is replenished via lower outlet 38 and upper inlet 40 as required.

Figure 3:
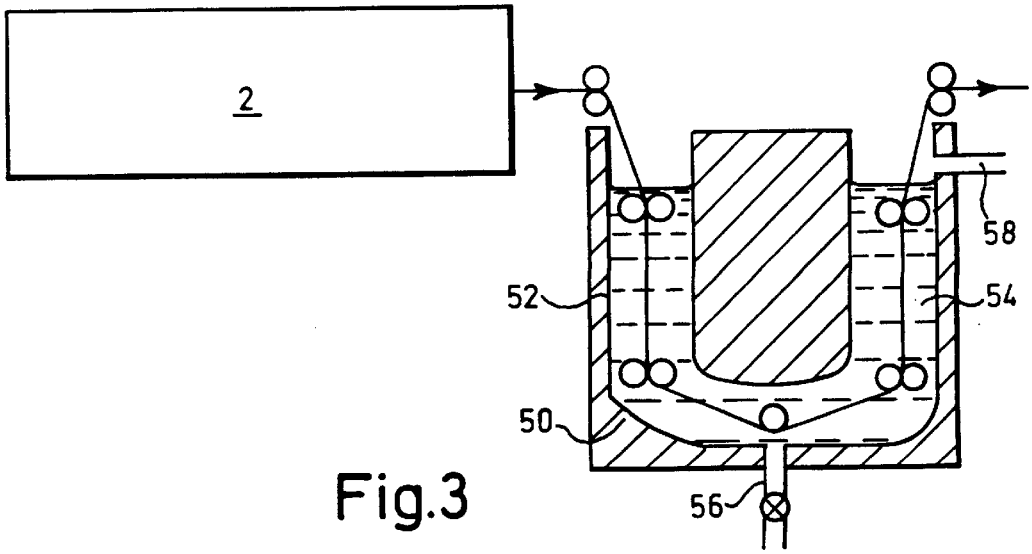

FIG. 3 shows a further modification of the apparatus, in which after leaving the surface processing stage 2, the film 4 enters a tank 50 and is guided by rollers therethrough in a U-shaped channel 52 in which the film 4 is immersed in a wash solution 54. The wash solution is replenished via lower outlet 56 and upper inlet 58 as required.

It is to be understood that various other changes and modifications may be made without departing from the scope of the present invention, the present invention being limited by the following claims.

What is claimed is:

1. Apparatus for processing photographic material, comprising: a surface processing stage, in which means is arranged to transport the material from an entrance to an exit of the stage while the material is supported on a substantially planar surface; and in which processing solution is applied to the material in at least two stages; the solution being applied to the material by contact with a roller arrangement; and a tank processing stage, in which means is arranged to guide the material down into, and subsequently up out of, a tank containing processing solution in which the material is immersed, and in which means is arranged for replenishing the processing solution in the tank.

2. Apparatus according to claim 1, wherein in the surface processing stage, the solution is applied only to the upper side of the material.

3. Apparatus according to claim 1, wherein in the tank processing stage, the material is guided between pairs of rollers.

4. Apparatus according to claim 3, wherein at least some of the rollers are immersed in the processing solution.

5. Apparatus according to claim 1, wherein in the tank processing stage, the material is guided through a channel defined in a tank.

6. Apparatus according to claim 5, wherein the channel is of generally U- or V-shape in elevation.

7. Apparatus according to claim 1, wherein in the tank processing stage, the material moves in a substantially vertical direction.

8. A method of processing photographic material, wherein the material is processed in at least two stages, one of the stages being a surface processing stage in which the material is transported on a substantially planar surface and in which processing solution is applied to one side thereof in at least two stages by contact with a roller arrangement, and another of the processing stages being a tank processing stage in which the material is guided down into, and subsequently up out of, a tank in which the material is immersed, and wherein the processing material in the tank is replenished in order to maintain its chemical activity at a level.

9. A method according to claim 8, wherein in the surface processing stage, the processing solution is deposited on the upper side of the material.

10. A method according to claim 8, wherein in the tank processing stage, the material is guided along a channel defined in a tank, preferably by means of a roller arrangement.

* * * * *